US008707628B1

(12) United States Patent
Stone

(10) Patent No.: US 8,707,628 B1
(45) Date of Patent: Apr. 29, 2014

(54) PLANTATION FAN TOP WINDOW SHUTTER

(71) Applicant: Lawrence Matthew Stone, Logan, UT (US)

(72) Inventor: Lawrence Matthew Stone, Logan, UT (US)

(73) Assignee: Sunburst Shutters Nevada, Inc., Las Vegas, NV (US)

( * ) Notice: Subject to any disclaimer, the term of this patent is extended or adjusted under 35 U.S.C. 154(b) by 0 days.

(21) Appl. No.: 13/731,282

(22) Filed: Dec. 31, 2012

Related U.S. Application Data

(62) Division of application No. 12/752,523, filed on Apr. 1, 2010, now Pat. No. 8,341,887.

(60) Provisional application No. 61/212,079, filed on Apr. 7, 2009.

(51) Int. Cl.
*E06B 3/00* (2006.01)

(52) U.S. Cl.
USPC ..... 49/506

(58) Field of Classification Search
USPC ..... 49/74.1, 82.1, 87.1, 90.1, 41, 506
See application file for complete search history.

(56) References Cited

U.S. PATENT DOCUMENTS

| | | | | | |
|---|---|---|---|---|---|
| 48,116 | A | * | 6/1865 | Wagenen | 49/90.1 |
| 397,322 | A | | 2/1889 | Whitaker | |
| 425,542 | A | | 4/1890 | Hantsche | |
| 595,854 | A | | 12/1897 | Lansing | |
| 657,367 | A | | 9/1900 | Starck | |
| 1,070,312 | A | | 8/1913 | Wilson | |
| 1,582,129 | A | | 4/1926 | Cornide | |
| 1,718,754 | A | | 6/1929 | Molina | |
| 1,989,010 | A | | 2/1935 | Howard | |
| 2,600,934 | A | | 6/1952 | Spieth | |
| 2,651,085 | A | | 9/1953 | Kopp | |
| 2,815,545 | A | | 12/1957 | Green | |
| 3,267,962 | A | | 8/1966 | Josephson et al. | |
| 3,447,443 | A | | 6/1969 | Silvey | |
| 4,192,083 | A | | 3/1980 | Rebbeck | |
| 5,147,132 | A | | 9/1992 | Lee | |
| 5,216,837 | A | | 6/1993 | Cleaver et al. | |
| 5,392,561 | A | | 2/1995 | Henley | |
| 5,471,789 | A | | 12/1995 | Faircloth | 49/74.1 |
| 5,537,780 | A | | 7/1996 | Cleaver et al. | |
| 5,592,793 | A | * | 1/1997 | Damratowski et al. | 52/182 |
| 5,713,156 | A | | 2/1998 | Briggs | |
| 5,782,051 | A | * | 7/1998 | LaVoie | 52/473 |
| 5,782,055 | A | | 7/1998 | Crittenden | |

(Continued)

FOREIGN PATENT DOCUMENTS

| | | | | |
|---|---|---|---|---|
| JP | 54121542 | A | 9/1979 | E06B 7/086 |

*Primary Examiner* — Jerry Redman
(74) *Attorney, Agent, or Firm* — Michael R. Schramm

(57) ABSTRACT

A plantation window shutter comprises a frame and a plurality of shutter blades pivotably supported by the frame in a fan configuration. The frame comprises a front surface and a rear surface. The rear surface has a plurality of upper grooves and a plurality of lower grooves, each upper groove being axially aligned with a respective lower groove. Each of the shutter blades has a longitudinal pivotal axis and a top pivot and a bottom pivot aligned along the axis, the top pivot and the bottom pivot being received in respective upper groove and the lower groove for pivotal motion therein. At least one member is attached to the rear surface disposed to bridge over the upper grooves and the lower grooves, thereby to capture the top and bottom pivots within respective the upper grooves and the lower grooves.

20 Claims, 19 Drawing Sheets

(56) References Cited

U.S. PATENT DOCUMENTS

| | | | | |
|---|---|---|---|---|
| 5,848,505 | A | 12/1998 | Taylor | |
| 5,918,417 | A | 7/1999 | Kinder | 49/39 |
| 6,257,301 | B1 * | 7/2001 | Conforti | 160/84.07 |
| 6,341,447 | B1 | 1/2002 | Jean | |
| 6,390,172 | B1 | 5/2002 | Fleishman et al. | 160/168.1 V |
| 6,449,903 | B1 | 9/2002 | Borcherding | |
| 6,536,162 | B2 | 3/2003 | LaMay | |
| 6,701,669 | B1 | 3/2004 | Yorgason | |
| 6,725,622 | B1 | 4/2004 | Hsu | |
| 6,758,256 | B1 | 7/2004 | Garcia | |
| 6,820,385 | B2 | 11/2004 | Horn et al. | |
| 6,877,546 | B1 | 4/2005 | Garcia | 160/134 |
| 7,043,331 | B2 | 5/2006 | Sigtryggsson et al. | |
| 7,080,490 | B2 | 7/2006 | Horn et al. | |
| 7,131,241 | B2 | 11/2006 | Blackwell et al. | |
| 7,296,384 | B2 | 11/2007 | Jaycox et al. | |
| D560,820 | S | 1/2008 | Downey et al. | D25/48.1 |
| 8,082,693 | B2 | 12/2011 | Marocco | 49/74.1 |
| 8,341,887 | B2 * | 1/2013 | Stone | 49/74.1 |
| 8,381,381 | B2 * | 2/2013 | Daniels | 29/428 |
| 2003/0009946 | A1 | 1/2003 | Wilson | 49/74.1 |
| 2003/0115817 | A1 | 6/2003 | Blackwell et al. | |
| 2004/0045220 | A1 | 3/2004 | Fraser et al. | 49/82.1 |
| 2005/0076569 | A1 | 4/2005 | Griffiths et al. | |
| 2005/0204668 | A1 | 9/2005 | Buchwald | |
| 2005/0284023 | A1 | 12/2005 | O'Hair | 49/74.1 |
| 2006/0101717 | A1 | 5/2006 | Marocco | |
| 2006/0162266 | A1 | 7/2006 | Hay | |
| 2006/0248801 | A1 | 11/2006 | Marocco | 49/74.1 |
| 2007/0000195 | A1 | 1/2007 | Garces et al. | |
| 2007/0193220 | A1 * | 8/2007 | Daniels | 52/784.11 |
| 2007/0289240 | A1 * | 12/2007 | Viviano | 52/446 |
| 2009/0071095 | A1 | 3/2009 | Buchwald | |
| 2009/0293400 | A1 | 12/2009 | Fraser | 52/473 |
| 2011/0126464 | A1 * | 6/2011 | Stone et al. | 49/82.1 |

* cited by examiner

FIG. 4
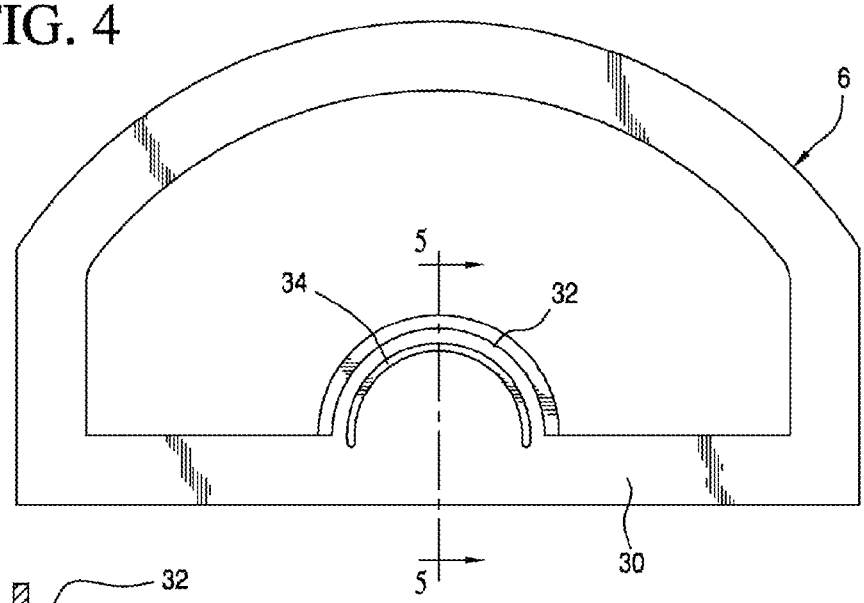
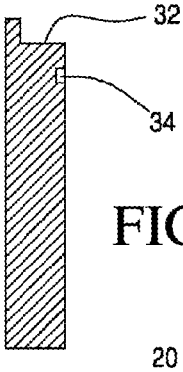
FIG. 5
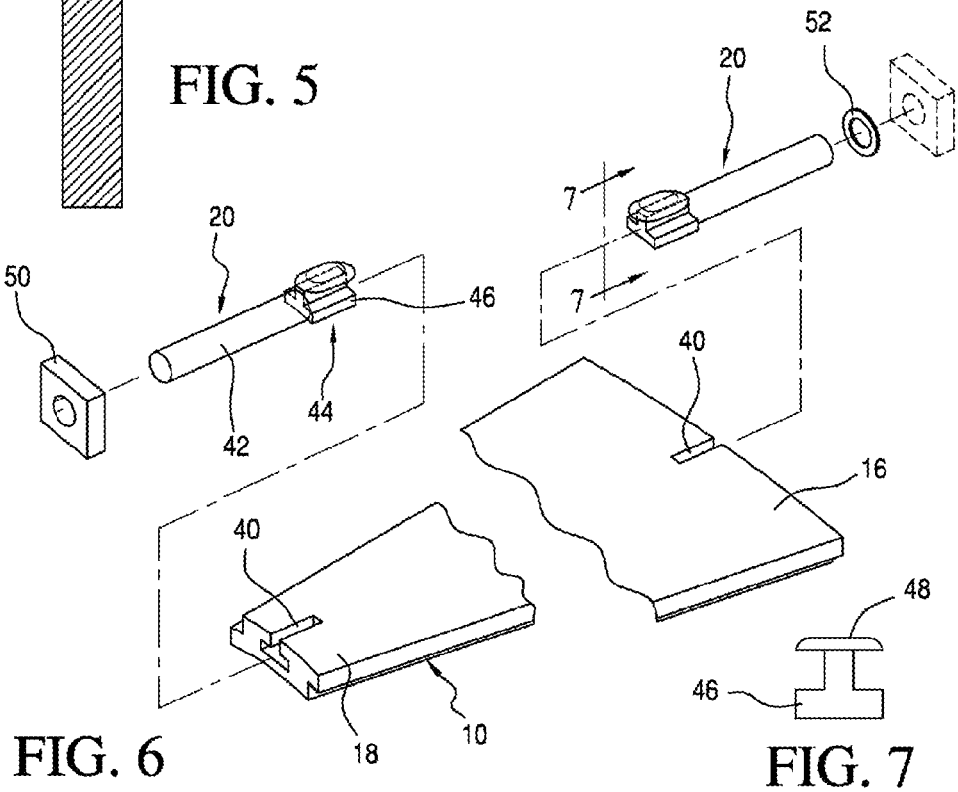
FIG. 6
FIG. 7

FIG. 11
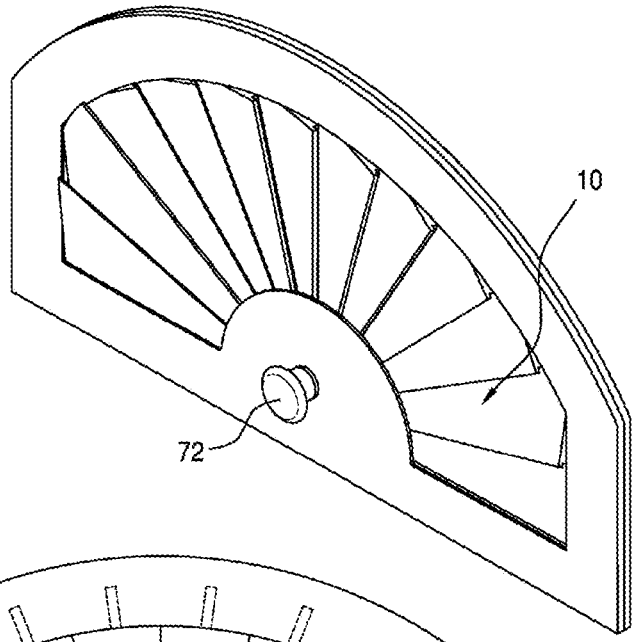
FIG. 12
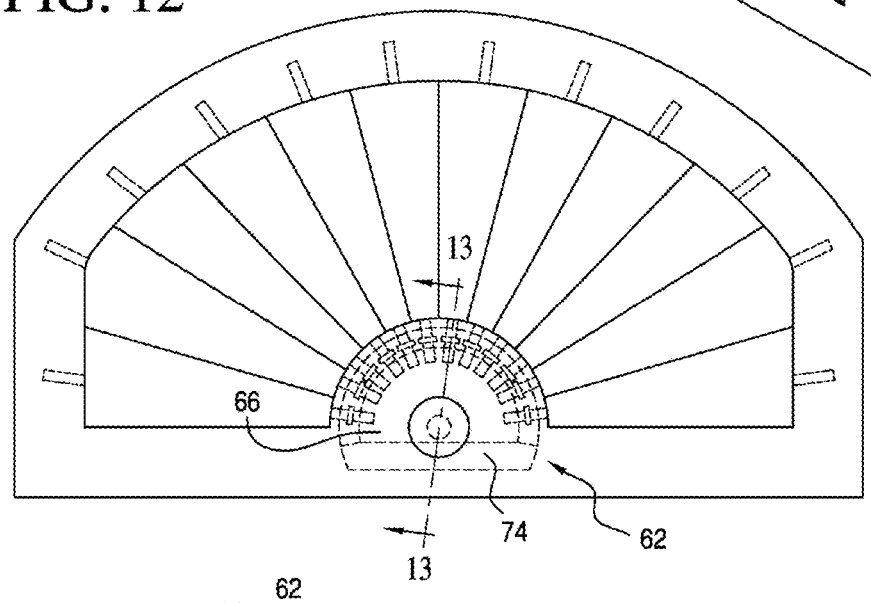
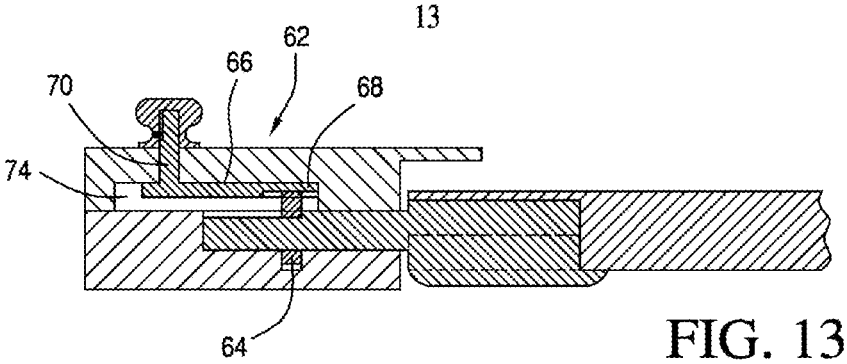
FIG. 13

PLANTATION FAN TOP WINDOW SHUTTER

CROSS REFERENCE TO RELATED APPLICATION

This nonprovisional utility application claims priority to and is a divisional application of U.S. patent application Ser. No. 12/752,523 filed Apr. 1, 2010 and since issued Jan. 1, 2013 as U.S. Pat. No. 8,341,887 which is a nonprovisional application of and claims the benefit under 35 USC §119(e) to U.S. Provisional Patent Application No. 61/212,079, filed Apr. 7, 2009, all of which are incorporated herein in their entirety by this reference.

FIELD OF THE INVENTION

The present invention relates generally to a window shutter and a method of making the same and particularly to an indoor plantation fan top window shutter.

BACKGROUND OF THE INVENTION

Plantation fan top window shutters are currently built by hand by trained craftsmen. Manufacturers of window shutters use a variety of wood working hand tools, complex formulas and highly trained expensive craftsmen. The present invention provides additional ways for manufacturing plantation top window shutters that reduce costs, improve quality, and reduce dramatically the time it takes to build them.

SUMMARY OF THE INVENTION

The present invention provides a plantation window shutter, comprising a frame and a plurality of shutter blades pivotably supported by the frame in a fan configuration. The frame comprises a front surface and a rear surface. The rear surface has a plurality of upper grooves and a plurality of lower grooves, each upper groove being axially aligned with a respective lower groove. Each of the shutter blades has a longitudinal pivotal axis and a top pivot and a bottom pivot aligned along the axis, the top pivot and the bottom pivot being received in respective upper groove and the lower groove for pivotal motion therein. At least one member is attached to the rear surface disposed to bridge over the upper grooves and the lower grooves, thereby to capture the top and bottom pivots within respective the upper grooves and the lower grooves.

The present invention also provides a method for manufacturing a plantation window shutter comprising a frame made of two substantially identical members attached together and a plurality of shutter blades pivotably supported by said frame, the method comprising the steps of providing shutter blade pivots with shaft portions and attachment portions; providing at least one sheet material; cutting the at least one sheet material with a CNC router machine to the shape of the frame members and the shutter blades; cutting grooves in one of the frame members with the CNC router machine to receive the shaft portions; cutting slots at each end of the shutter blades with the CNC router machine to receive the attachment portions; and assembling the frame members and the shutter blades.

DESCRIPTION OF DRAWINGS

FIG. 4 is a rear view of the front member of the frame shown in FIG. 3.

FIG. 5 is a cross-sectional view taken along line 5-5 in FIG. 4.

FIG. 6 is a perspective assembly view of a shutter blade.

FIG. 7 is a cross-sectional taken along line 7-7 in FIG. 6.

FIG. 11 is a front perspective of another embodiment of the shutter shown in FIG. 1.

FIG. 12 is a front view of the shutter of FIG. 11.

FIG. 13 is a cross-sectional view taken along line 13-13.

DETAILED DESCRIPTION OF THE INVENTION

Figure 1:
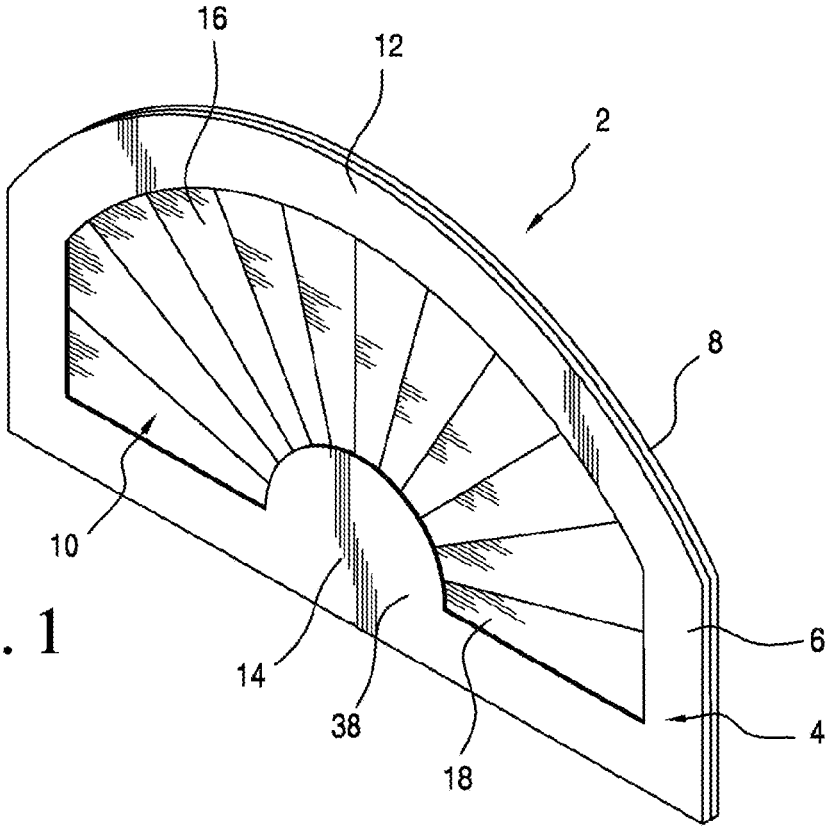
FIG. 1 is a front perspective view of window shutter embodying the present invention.
Figure 2:
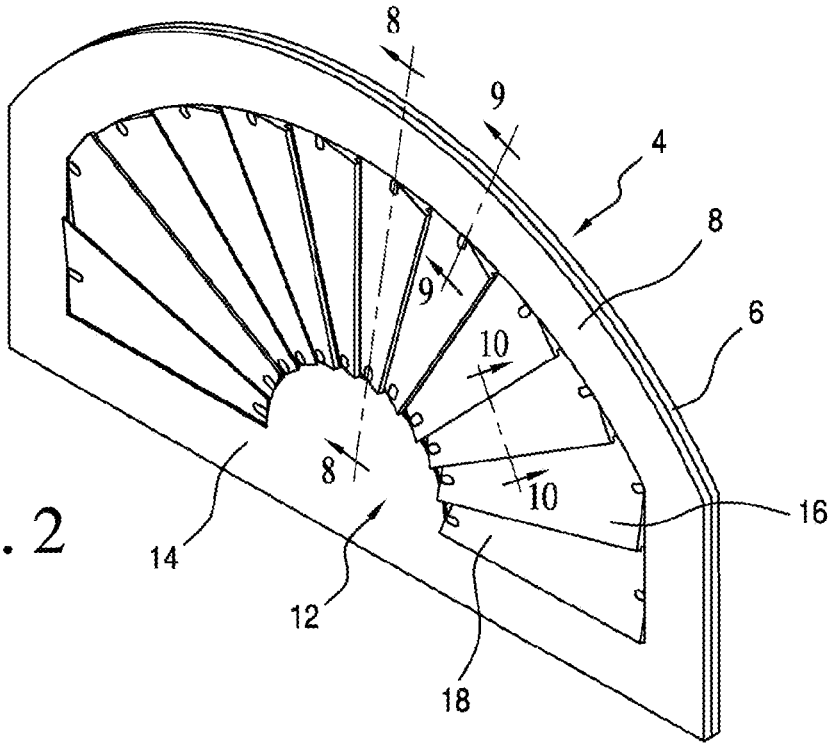
FIG. 2 is rear perspective view of FIG. 1.
Figure 3:
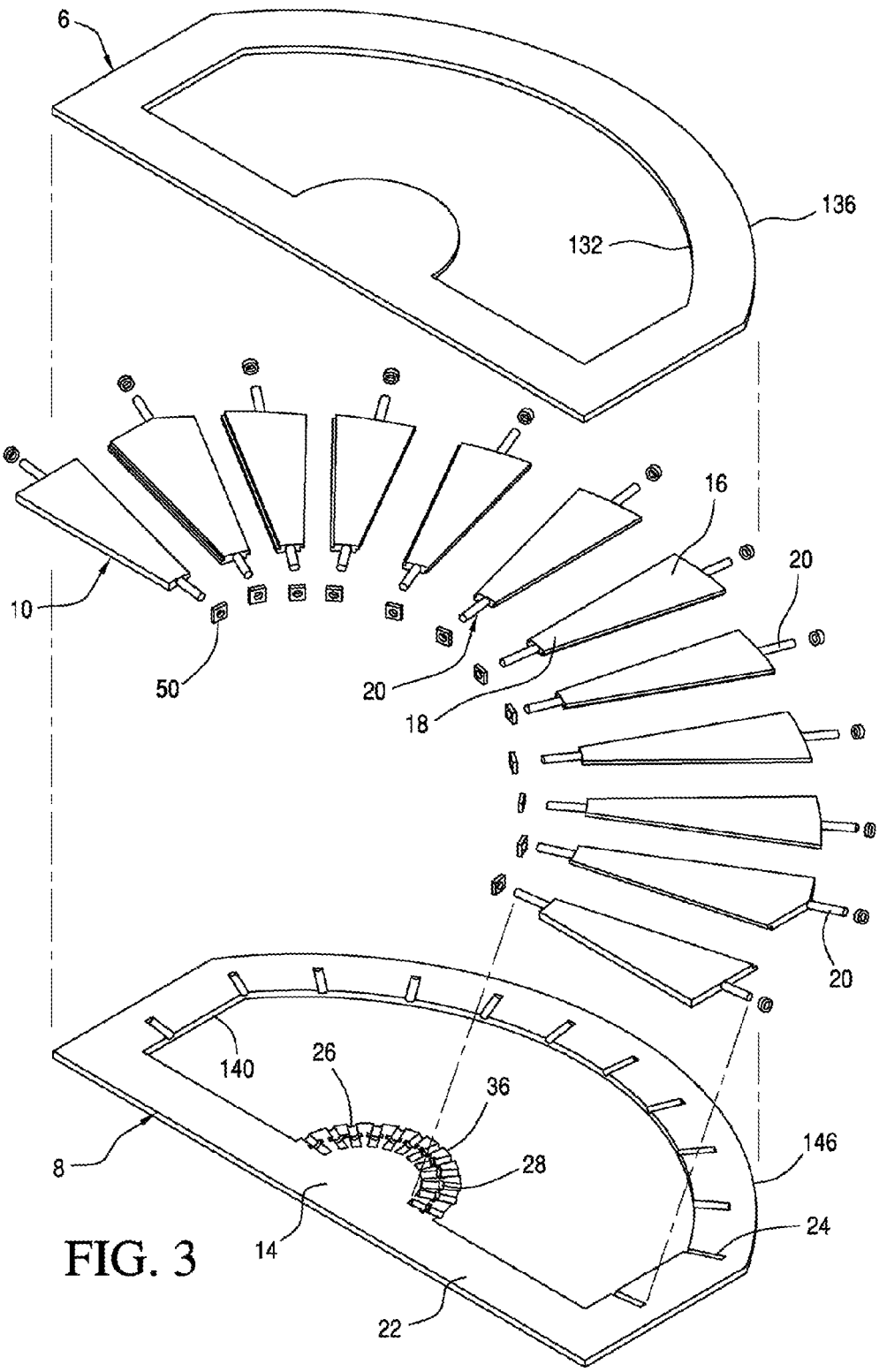
FIG. 3 is an assembly view of the shutter shown in FIG. 1.

Referring to FIGS. 1, 2 and 3, an indoor fan top window shutter 2 embodying the present invention is disclosed. The shutter 2 has a frame 4 having a front member 6 and a rear member 8 attached together, preferably with glue, screws or other conventional ways, to form one unit. The front member 6 is substantially identical in shape to the rear member 8. A plurality of shutter blades 10 are pivotably supported by the frame 4 in a fan configuration wherein the longitudinal pivotal axes of the blades 10 intersect at a common point.

The frame 4 has an upper portion 12 and a lower portion 14. The blades 10 have top portions 16 pivotably attached to the upper portion 12 and bottom portions 18 pivotably attached to the lower portion 14 with pivots 20, as will be described below. The upper 12 may be arcuate or angular (see FIG. 21(*m*)).

Referring to FIG. 3, the rear member 8 has a front surface 22 having a plurality of upper grooves 24 and lower grooves 26 disposed on the corresponding upper portion 12 and the lower portion 14 of the rear member 8. Each upper groove 24 is associated with a respective lower groove 26 along a longitudinal pivotal axis of the respective shutter blade 10. The lower grooves 26 each includes a transverse slot 28, as will be described below.

Referring to FIGS. 4 and 5, the front member 6 has a rear surface 30 having a ledge 32 and a groove 34 disposed on the corresponding lower portion of the member 6. The groove 34 substantially aligns with the series of slots 28 on the opposite front surface 22 of the rear member 8. The ledge 32 substantially lines up with an outer edge of 36 of a hub portion 38 at the lower portion 17 of the rear member 8 such that when the shutter blades 10 are pivoted, their lower edges can overlie the ledge 32, thereby allowing freedom of motion for the shutter blades 10.

A plurality of pivots 20 are each attached to a respective top portion 16 and bottom portion 18 of a shutter blade 10. Referring to FIG. 6, a slot 40 is disposed at the top portion 16 and the bottom portion 18 of each shutter blade 10, each pair of slots 40 being aligned along the longitudinal pivotal axis of the blade 10. Each slot 40 is preferably T-shaped in cross-section.

Each pivot 20 has a shaft portion 42 and an attachment portion 44. The shaft portion 42 is receivable within respective grooves 24 and 26 in the rear member 8. The attachment portion is receivable with the respective slot 40 in each blade 10. The attachment portion 44 has a T-shaped portion 46 when viewed in cross-section that is receivable within the T-shaped slot 40, preferably with a friction fit, as shown in FIG. 7. The attachment portion 44 also includes a cover portion 48 that overlies and covers the slot 40 when the attachment portion 44 is inserted into the slot 40. The pivots 20 are preferably molded from plastic or suitable material.

A washer 50, preferably rectangular so that it can be held stationary while the shutter blade 10 is actuated and made of compressible material, such as rubber or elastomeric plastic, is attached to the shaft portion 42 of each bottom-disposed pivot 20. The washer 50 has a friction fit with the shaft portion 42 that allows the respective shutter blade 10 to be pivoted within its range of motion and be held secured to its pivoted position without looseness. Each washer 50 is disposed within the respective slot 28. A portion of the washer 50 is also received within the groove 34 on the opposite rear surface 30 of the front member 6.

A washer 52 is attached to the shaft portion 42 of each top-disposed pivot 20. The washer 52 acts as a spacer between the bottom edge of the upper portion 12 of the frame 6 and the top edge of the shutter blade 10.

Figure 8:
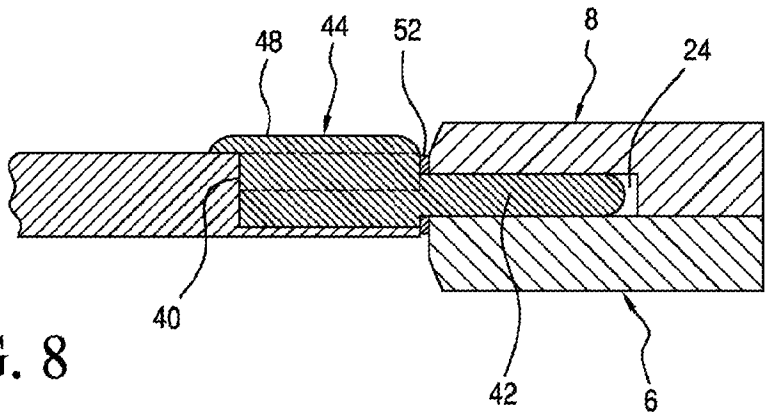
FIG. 8 is a cross-sectional view taken along line 8-8 in FIG. 2.

Referring to FIG. 8, the shaft portion 42 of each pivot 20 is captured within the respective grooves 24 and 26 when the front member 6 is attached to the rear member 8 to bridge over the grooves during assembly. The member 6 functions as a cover for the grooves 24 and 26. It is preferable to configure the grooves 24 and 26 such that the diameter of the shaft portion 42 of the respective pivot 20 is completely contained therein for ease of manufacture. However, it should be understood that the depth of the grooves 24 and 26 may be divided between the members 6 and 8. It should also be understood that the grooves 24 and 26 and the slots 28 may also be disposed on the rear surface 30 of the front member 6.

Figure 9:
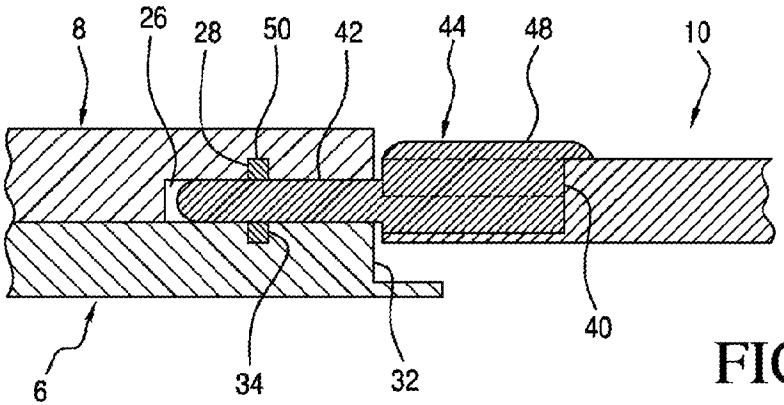
FIG. 9 is a cross-sectional view of an alternate embodiment taken along line 9-9 in FIG. 2.
Figure 9:
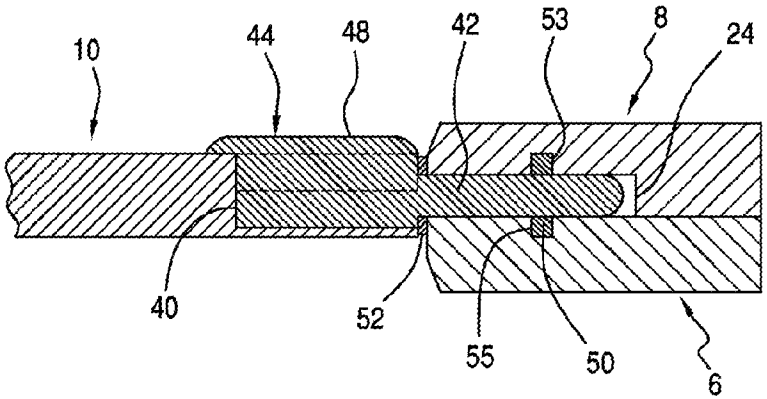
Figure 14:
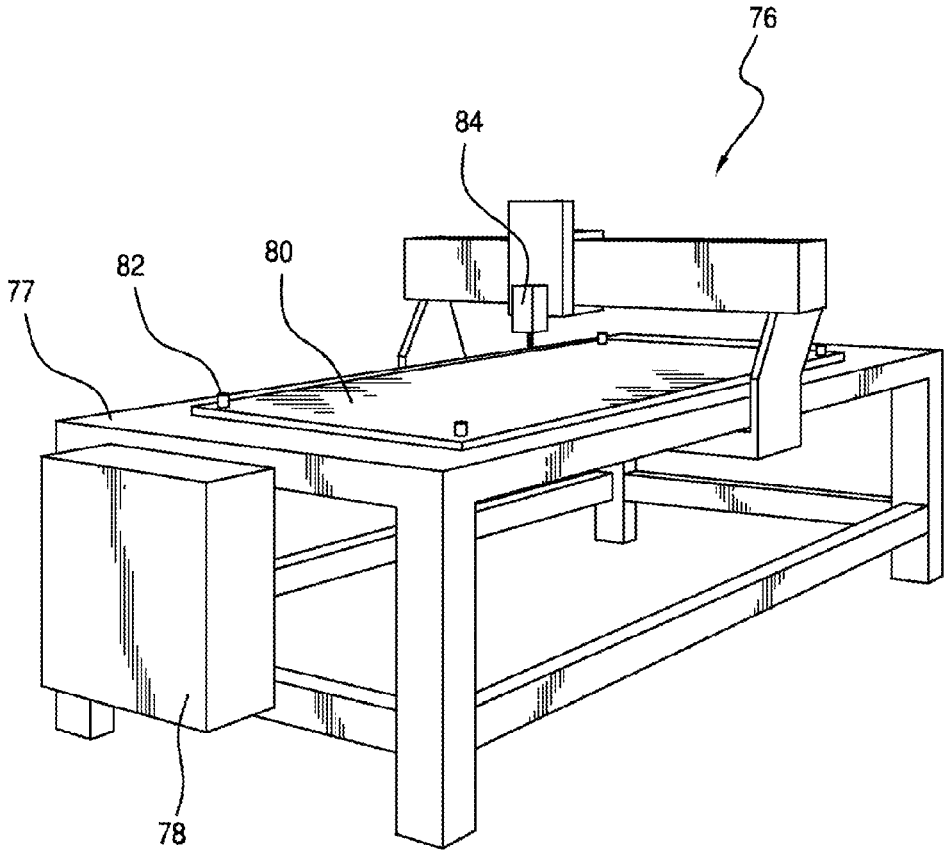
FIG. 14 is a perspective schematic view of a CNC router machine used in making the shutter of FIG. 1.
Figure 15:
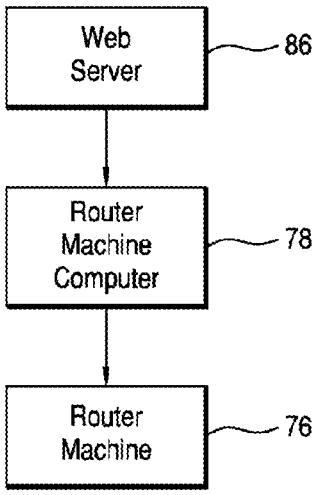
FIG. 15 is a functional block diagram of a system used in making the shutter of FIG. 1.
Figure 16:
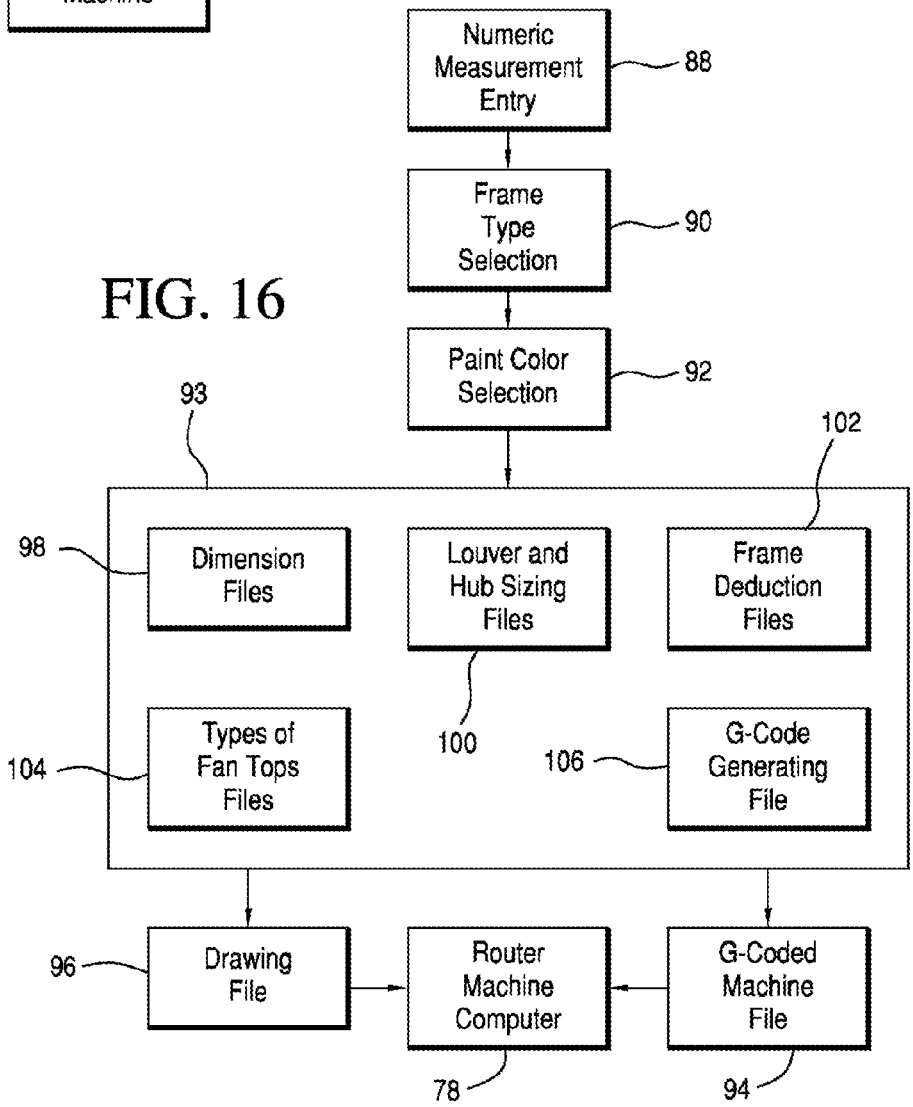
FIG. 16 is a flowchart of a system used in making the shutter of FIG. 1.
Figure 17A:
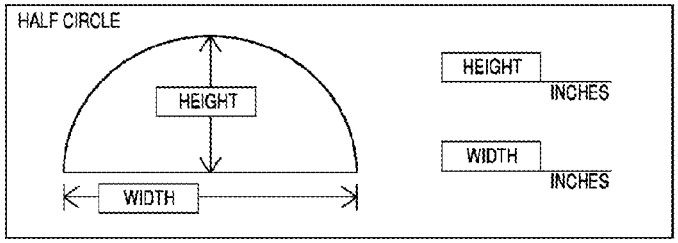
FIGS. 17(*a*)-17(*i*) show the various exemplary input displays for entering window measurements.
Figure 17B:
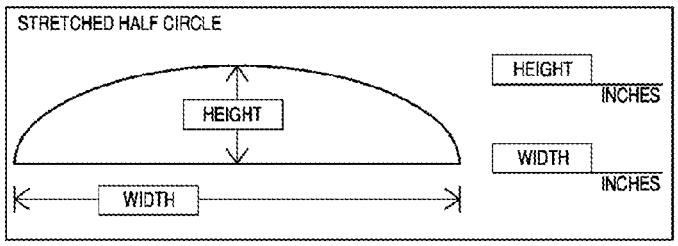
Figure 17C:
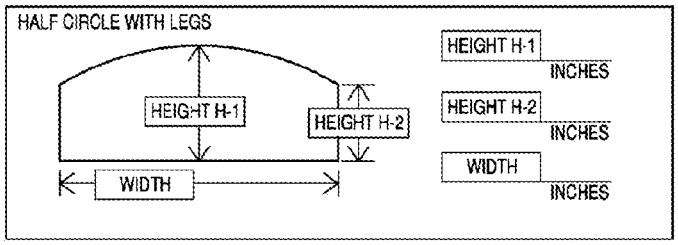
Figure 17D:
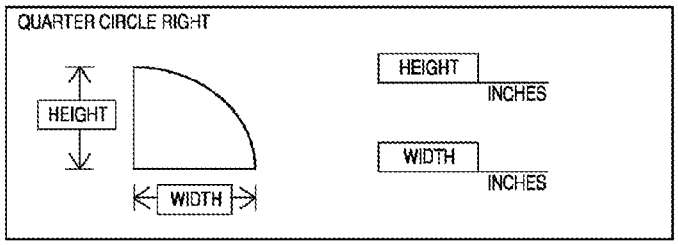
Figure 17E:
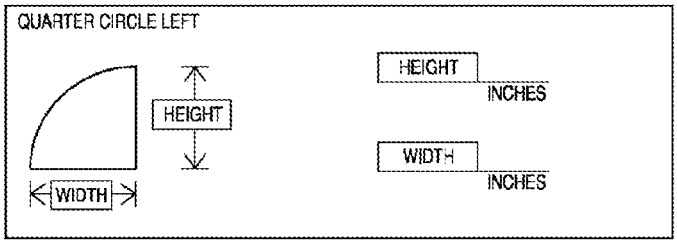
Figure 17F:
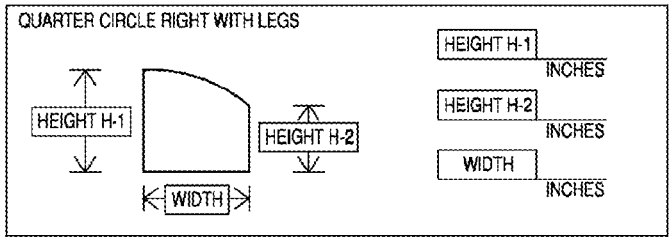
Figure 17G:
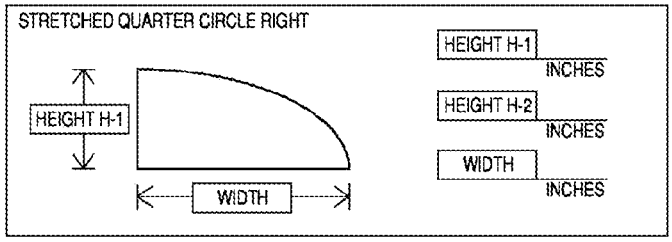
Figure 17H:
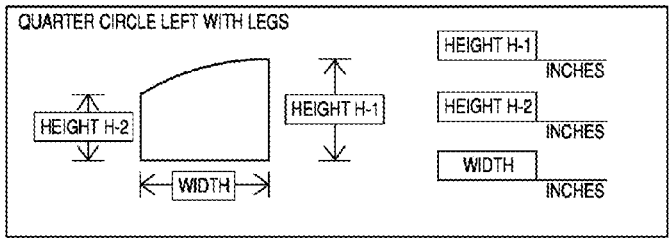
Figure 17I:
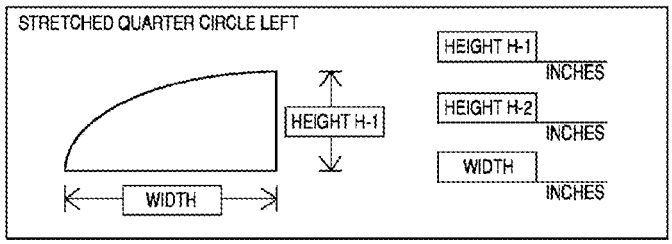

It should also be understood that the washer 50 may be disposed on the shaft portion 42 of the respective top-disposed pivot 20, instead of being at the bottom-disposed shaft portion 42. The corresponding slots 28 and 34 on the front and rear surfaces 14 and 30, respectively, would then be disposed transversely across each upper groove 24 and on the front surface 14 and on the opposite rear surface 30, shown as slot 53 and groove 55, respectively, as shown in FIG. 9.

Figure 10:
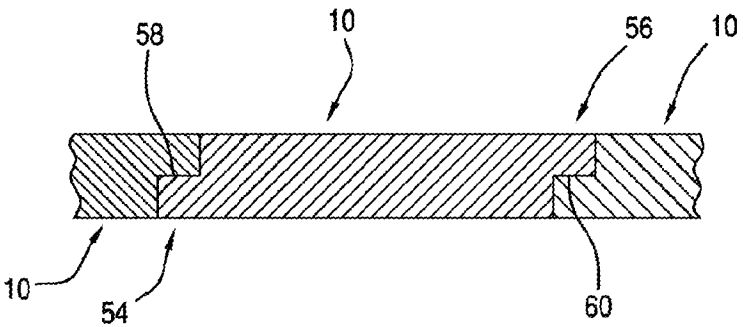
FIG. 10 is a cross-sectional view taken along 10-10 in FIG. 2.

Referring to FIGS. 6 and 10, the shutter blades 10 advantageously overlap one another along their respective longitudinal left edge 54 and right edge 56. The left edge 54 is preferably provided with a top recess 58 and the right edge 56 with a bottom recess 60 for a counterclockwise rotation, from the perspective of FIG. 10, for opening the shutter blades 10. Although the recesses 58 and 60 are shown rectangular, other profiles may equally work.

Referring to FIGS. 11-13, a mechanism 62 for operating the shutter blades 10 to the open or closed position is disclosed. The mechanism includes a plurality of gears 64, in place of the washers 50, fixedly attached to the respective shaft portion 42 of the respective bottom-disposed pivots 20. A rotatable plate 66 has a series of indentations or gear track 68 that mesh with the gears 64 such that when the plate 66 is rotated about a pivot 70, the indentations cause the gears 64 to rotate, thereby pivoting the shutter blades 10. A knob 72 is fixedly attached to the pivot 70 for operating the plate 66. A recess 74 on the rear surface 30 of the front member 6 houses the plate 66 and provides sufficient space for its pivoting movement for closing or opening the shutter blades 10.

The shutter 2 is preferably made from wood or plastic sheet material. The various components of the shutter 2 are preferably cut from the sheet material using a CNC router machine 76, such as Camaster Cobra X3, made by Camaster CNC, Inc., Calhoun, Ga. 30701.

The CNC router machine 76 is computer driven and is well known in the art. The machine 76 includes a table surface 77 on which a board 80 to be cut is placed. Alignment or indexing pins 82 hold the board 80 in precise location when the board is turned over for cutting on the other side. A router head 84 is movable on the X-Y plane of the table surface 78. The router 84 is also movable on the Z-axis, which is perpendicular to the X-Y plane.

The router computer 78 is preferably connected to a server 86 via the internet or other network connections. The web server 86 includes software that generates the programming steps required to drive the router machine 76 to cut the components of the shutter 2 from the board 80. Based on the measurements of a window in which the shutter 2 will installed, the software in the server 86 will generate the programming steps to drive the router head 84. The server 86 may be connected to a number of other router machines 76 in various locations. An operator for each machine need not know how to program the machine, since the required programming is downloaded to the router machine computer 78 from the server 86 after the operator provides the window measurements.

An example of the process of making and assembling the various components of the shutter 2 will now be described. An operator inputs at step 88 the numeric measurements of a window in which the shutter 2 will be installed. Examples of the type of shutters and the required measurements are shown in FIGS. 17(*a*)-17(*h*). Referring to FIG. 17(*c*), which shows the shutter 2, height-1 at the top center part of the shutter and the width are measured. In addition, the height-2 of the legs of the shutter is also measured. If a frame is added to the shutter 2 (see FIG. 21(*e*)), a frame type is selected at step 90. Paint color selection may also be made at step 92. These inputs are then sent by the operator to the server 86.

A program 93 resident within the server 86 or in another computer connected to the server 86 converts the operator's input at steps 88 and 90 into a G-code file 94, which is downloaded to the router machine computer 78. In addition, a drawing file 96 is also generated and downloaded to the router machine computer 78. The drawing file 96 generates a drawing of the shutter ordered by the operator as a visual check to the operator on what the shutter looks like before the components are cut by the router machine 76.

The program 93 includes dimension files 98, louver and hub sizing files 100, frame deduction files 102, types of fan tops files 104 and G-code generating files 106.

The dimension files 98 are a database developed around the sizes of the shutter shown in FIGS. 17(*a*)-17(*i*). The database consists of measurements of each shutter type shown in FIGS. 17(*a*)-17(*i*), from the smallest to the largest. Since there is rarely two windows of the same size, based on the measurement provided by the operator at step 88, the program searches from the list of dimensions that have been loaded into the database covering, for example, an 18 in.×18 in. window up to a 4 ft. high×8 ft. window. Shutter measurements with width dimensions of 18⅛, 18¼, 18⅜, 18½ and so on up, 95½, 95⅝, 95¾, 95⅞, 96 in; and height measurements of 18⅛, 18¼, 18⅜, 18½ and so on up, 47½, 47⅝, 47¾, 47⅞, 48 in. are in the database. The shutter measurements that fit the size of the window in which the shutter will be installed is then selected.

Examples of types of fan tops included in the files 104 are shown in FIGS. 17(*a*)-17(*i*) and FIGS. 21(*a*)-21(*m*) and include half-circle, half-circle with legs, left and right quarters, full circle, oval, octagon and variations of these shapes.

Figure 18A:
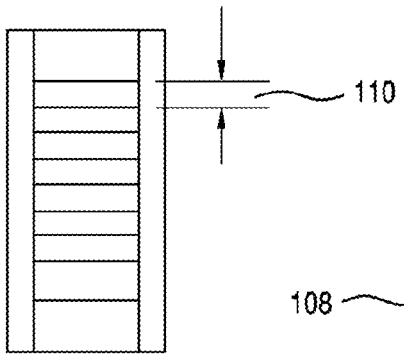
FIGS. 18(*a*)-18(*b*) illustrate matching the width of a rectangular window shutter blade with the outer width of a shutter blade of FIG. 1.
Figure 18B:
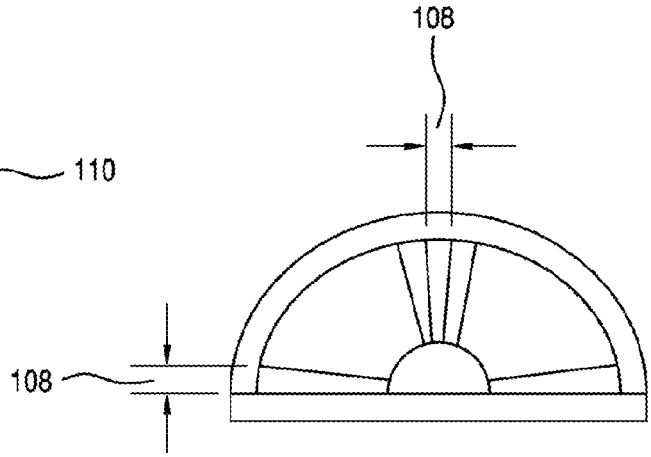

Louver and hub sizing files 100 provide the size of the hub portion 38 of the frame 4 and the number of shutter blades 10 appropriate for the size of the window in which the shutter 2 will be installed. As the shutter increases in size, the hub portion 38 (see FIG. 1) and the number of shutter blades also increase. Since the shutter 2 is typically installed with other shutters, such as a rectangular shutter shown in FIG. 18(*a*), the program preferably selects the appropriate number of shutter blades 10 such that the width 108 of the top portion 16 of the shutter blade 10 is substantially the same as the width 110 of the horizontal shutter blade in the rectangular shutter. The rectangular shutter has shutter blade width sizes of 2½, 3½ and 4½ in. The program goes through these measurements and picks the right combination of the hub portion size and the number of shutter blades 10 to keep the dimensions 108 and 110 substantially the same. There are six different hub and blade size sets and the program selects from 10, 12, 18, 24, 30 and 40 blades.

Figure 20:
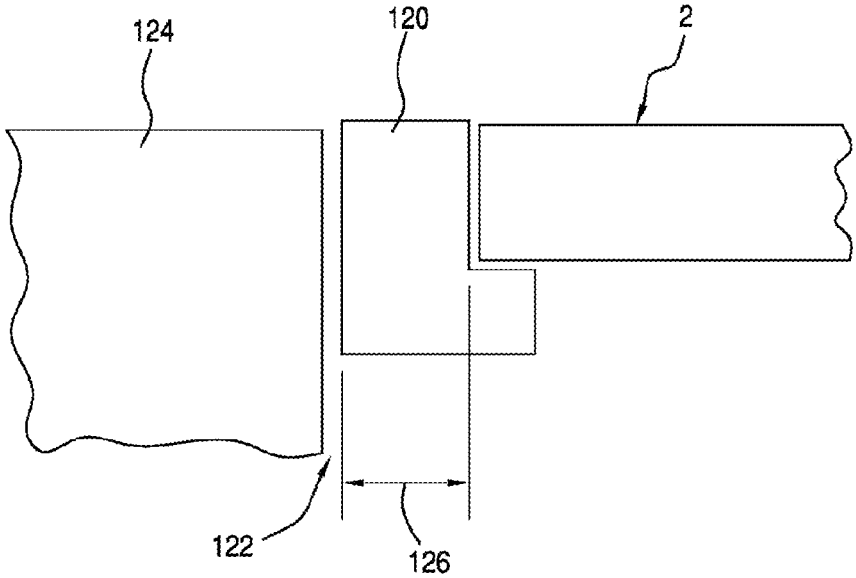
FIG. 20 illustrates an example calculation in reducing the size of the shutter of FIG. 1 to account for the dimensions of a separate frame around the shutter of FIG. 1.
Figure 19A:
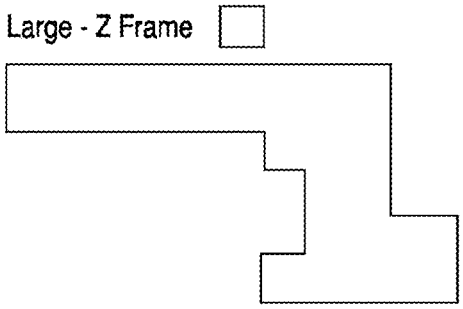
FIGS. 19(*a*)-19(*f*) illustrate the various cross-sectional profiles of a frame for use with the shutter of FIG. 1.
Figure 19B:
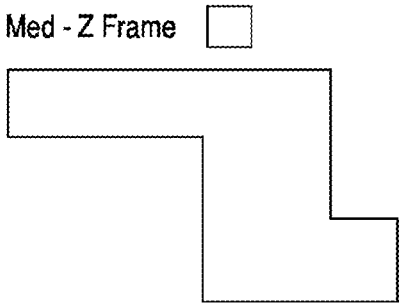
Figure 19C:
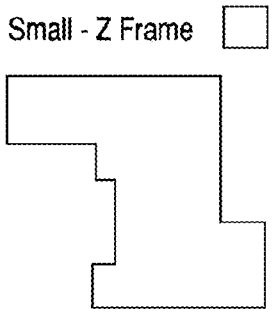
Figure 19D:
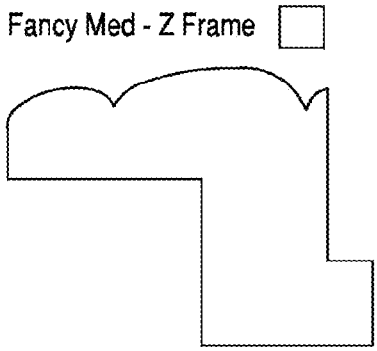
Figure 19E:
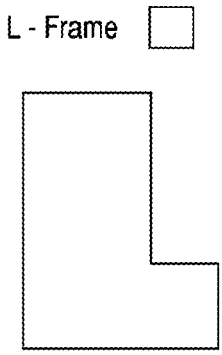
Figure 19F:
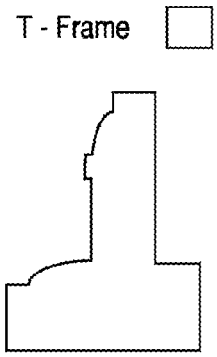
Figure 21A:
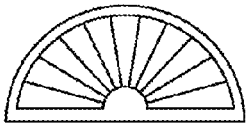
FIGS. 21(*a*)-21(*m*) illustrate the various shutter drawings generated by the system based on the window measurement inputted by the customer.
Figure 21B:
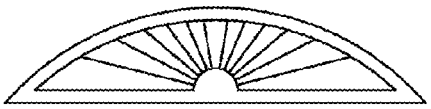
Figure 21C:
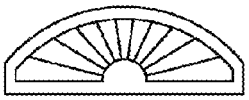
Figure 21D:
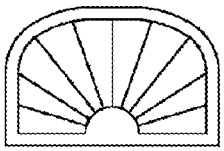
Figure 21E:
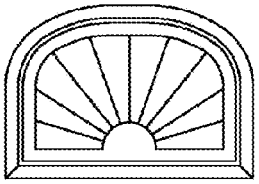
Figure 21F:
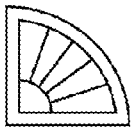
Figure 21G:
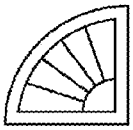
Figure 21H:
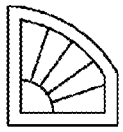
Figure 21I:
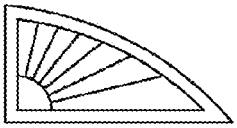
Figure 21J:
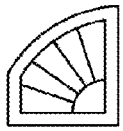
Figure 21K:
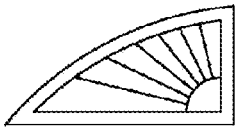
Figure 21L:
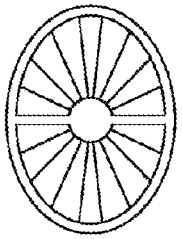
Figure 21M:
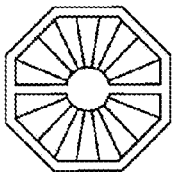
Figure 22A:
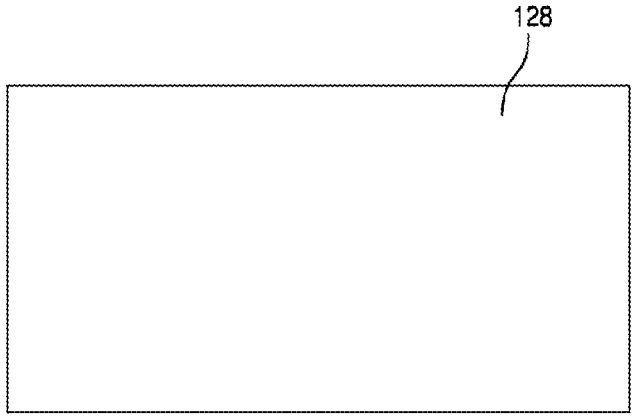
FIGS. 22(*a*)-22(*g*) show the various cuts made by the CNC router machine in one board to make some of the components of a shutter.
Figure 22B:
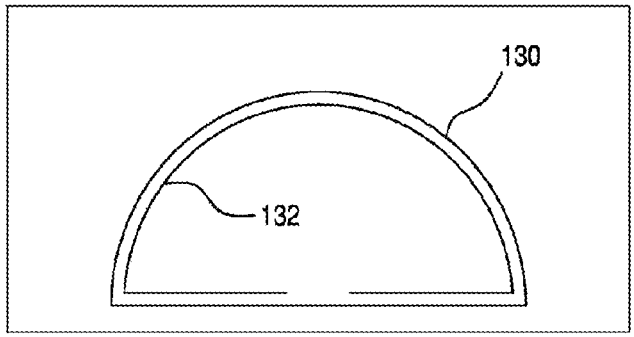
Figure 22C:
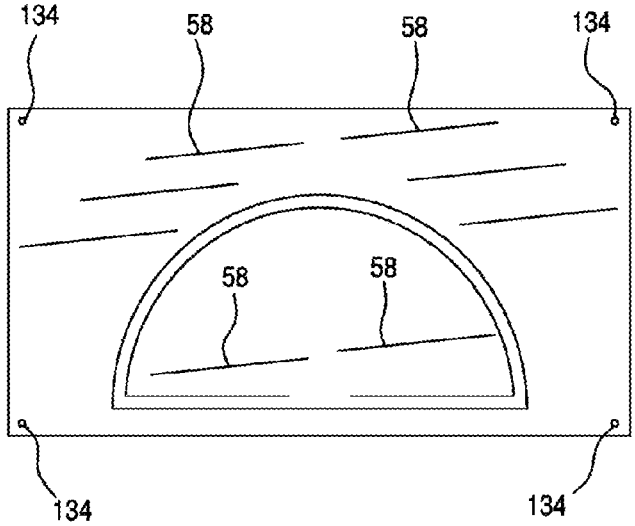
Figure 22D:
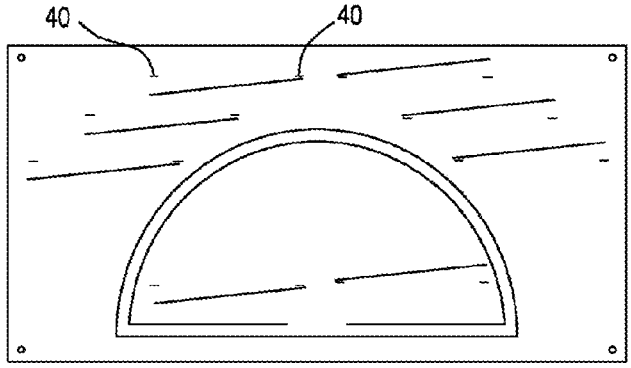
Figure 22E:
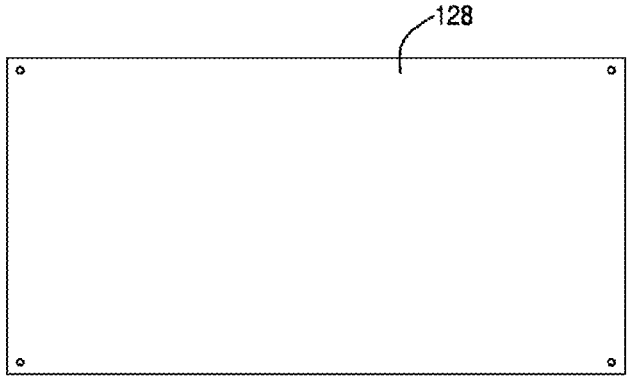
Figure 22F:
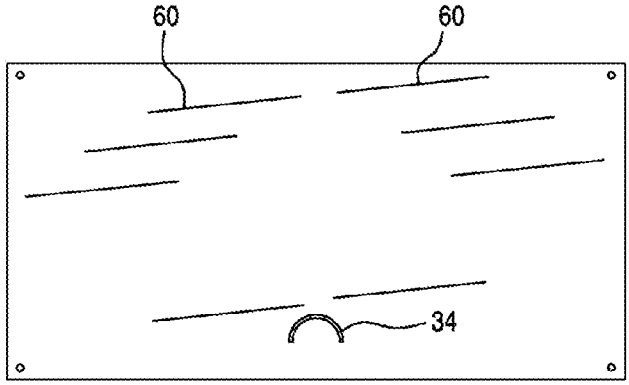
Figure 22G:
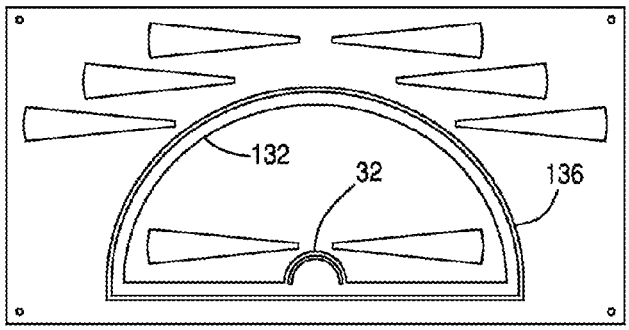
Figure 23A:
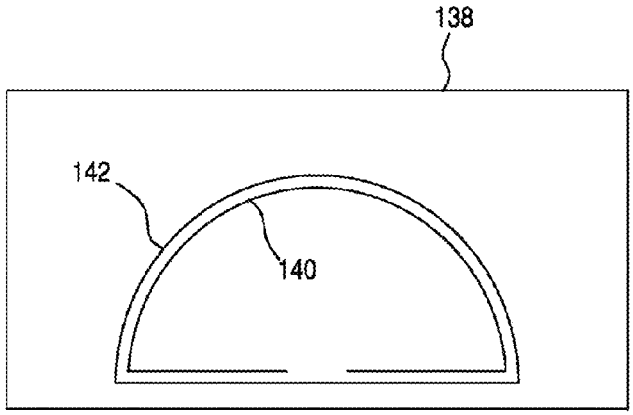
FIGS. 23(*a*)-23(*f*) show the various cuts made by the CNC router machine in another board to make the rest of the components of a shutter.
Figure 23B:
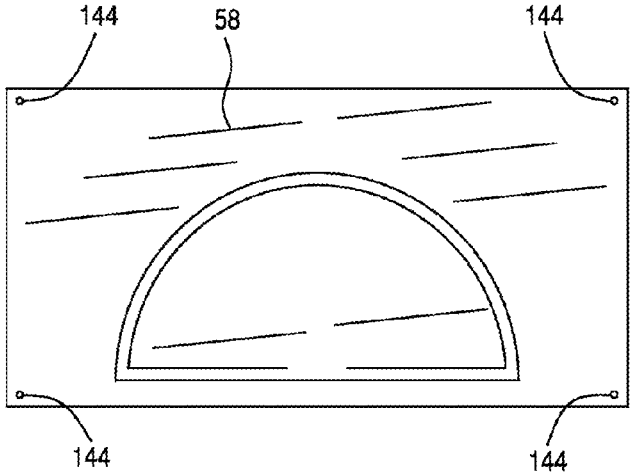
Figure 23C:
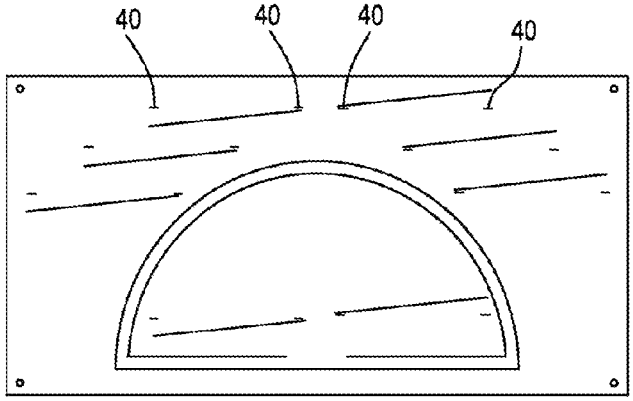
Figure 23D:
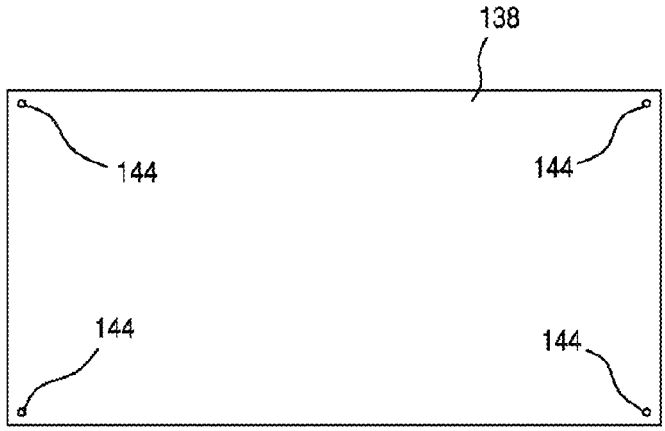
Figure 23E:
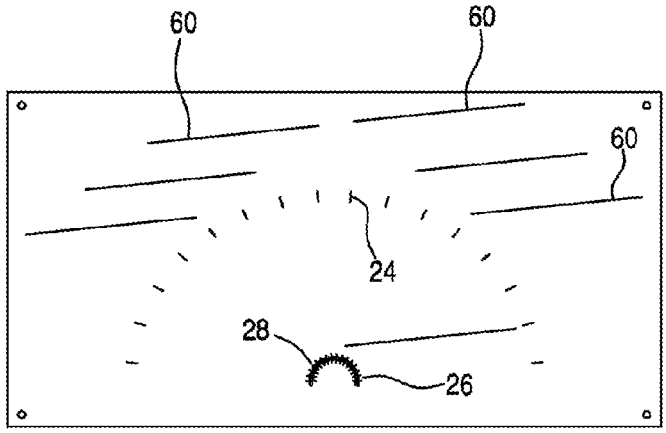
Figure 23F:
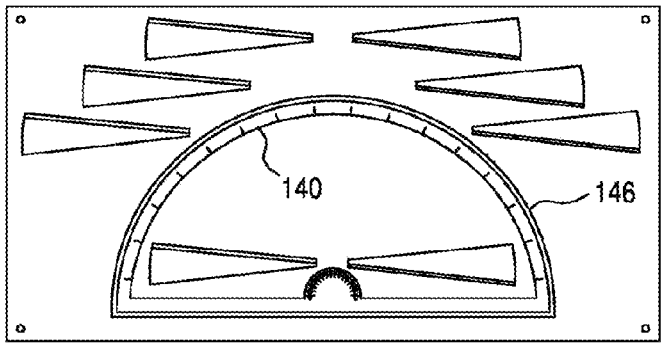
Figure 24A:
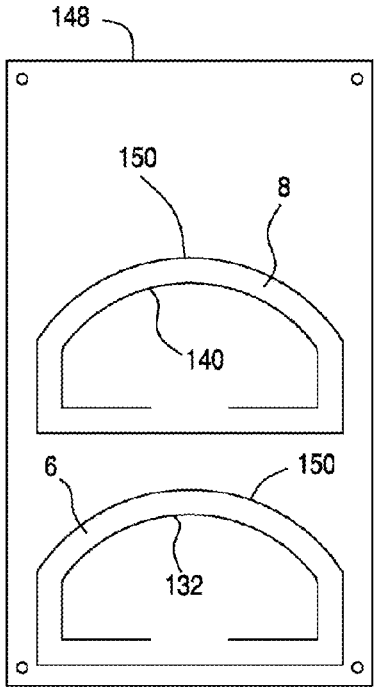
FIGS. 24(*a*)-24(*f*) show the various cuts made by the CNC router machine in a single board to make the components of a shutter.
Figure 24B:
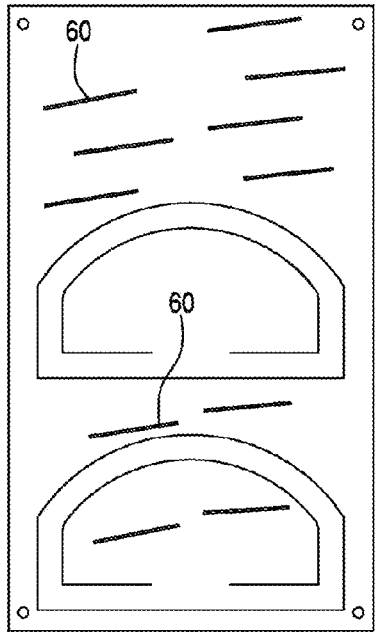
Figure 24C:
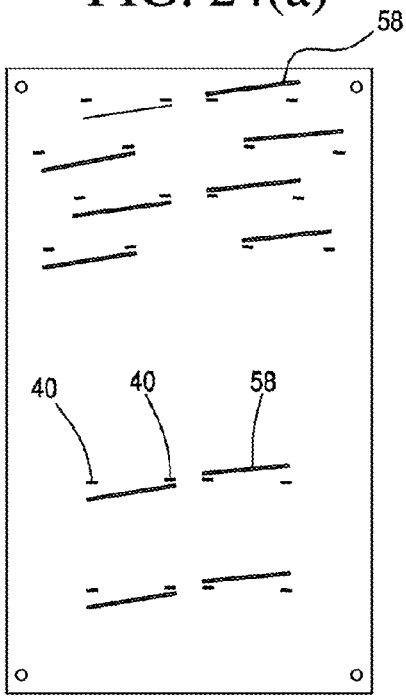
Figure 24D:
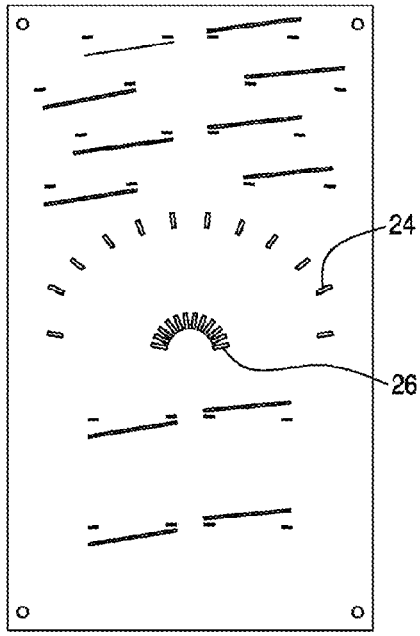
Figure 24E:
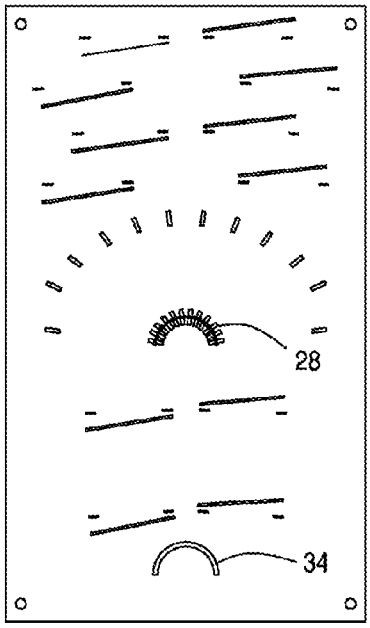
Figure 24F:
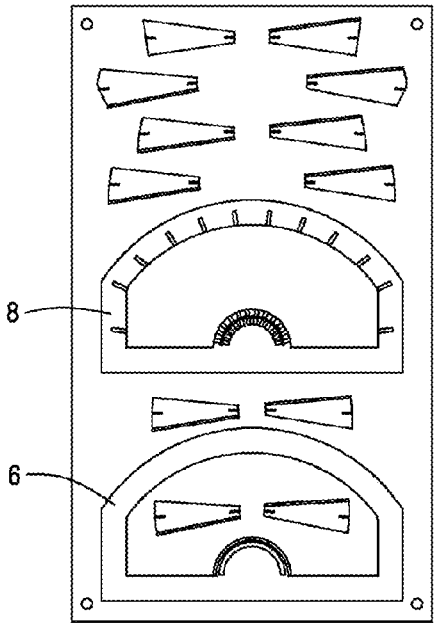

The frame deduction files 102 allow for reductions in measurements provided at step 88 to accommodate a frame if ordered by the operator to be included with the shutter 2. Examples of frame profiles provided in the program are shown in FIGS. 19(*a*)-19(*f*). The measurements of these frame profiles have been loaded into the program. Depending on the frame profile chosen, the program calculates the deductions to shrink the shutter size to accommodate the frame. For example, referring to FIG. 20, an L-frame 120 is provided with the shutter 2. The frame 120 will have a clearance 122 of ⅛ in. around the window frame 124. Since the frame face has a dimension 126 of 1 in., the shutter will be 2⅜ in. less in height and 2⅜ in. in width than the measurement provided at step 88.

Examples of the various shutter drawings generated and provided to the operator to show the shutter configuration based on the input at step 88 is shown in FIGS. 21(*a*)-21(*k*). The drawings advantageously provide a visual confirmation for the operator of the correct type of shutter ordered before cutting the component parts from the board.

The G-code machine file 94 is standard G-code software used for motion control of the cutting tool of the router machine 76 that does the actual work. The G-code machine file 94 includes router tool selection, machine feed rates, tool speeds, tool paths and cutting depths. The G-codes direct the machine actions, such as rapid move; controlled feed move in a straight line or arc; series of controlled feed moves for boring holes; cutting a workpiece to a specific dimension; cutting a decorative profile shape to the edge of a workpiece; change tool; etc. The generation of G-codes for driving the router machine 76 are well known in the art. The G-codes may be generated using a standard drawing software package, such as AUTOCAD, available from Autodesk, Inc., 111 McInnis Parkway, San Rafael, Calif. 94903 and a standard G-code generating software package, such as ALPHACAM, available from Planit Solutions, Inc., 3800 Palisades Drive, Tuscaloosa, Ala. 35405. For example, referring to FIGS. 22(*b*)-22(*g*) and FIGS. 23(*a*)-23(*f*), each figure is generated by the drawing software, which is then converted by the G-code generating software into a G-coded machine file that will drive the router machine 76 to cut the various pieces for the shutter. The G-coded machine file is sent to the router machine computer 78 using standard connections, such as the Internet or other network connections.

The generation of the G-coded machine file 94 may also be automated by storing a database of G-code files that would be used in cutting any type and size of shutter for which the system is designed. These G-code files include all the necessary machine operations, such as the tool path, tool selection, depth of cut, tool rpm, feed speed, etc. for cutting the parts for any type and size of shutter stored in the system. Data on the dimensions of the ordered shutter, including the number of shutter blades, the hub portion size and any frame deduction generate a drawing file comprising several layered views. Each view is then associated with the appropriate G-code files already stored in the system. All the selected G-code files for all the views are then sent to the router machine computer 78 via the internet or other network connections.

The cutting process will now be described with reference to a half-circle shutter generally shown in FIG. 21(*a*). The various reference numerals used in describing the shutter 2, which is a half-circle with legs, will also be used for the same parts in describing the process for the half-circle shutter. The shutter in this example has 16 shutter blades and will require two 4 ft.×8 ft.×½ in. PVC boards.

The first board will provide the front member 6 of the frame 4 and eight shutter blades 10. Referring to FIGS. 22(*a*)-22(*g*), a 4 ft.×8 ft. PVC board 128 is placed on the table surface 77 of the CNC router machine 76. Referring to FIG. 22(*b*), a V-cutting tool is used to make a decorative groove 130, typically ⅛ in. deep. At a different depth less than the thickness of the board, for example ¼ in., the cutting tool cuts the inner edge 132 (see FIG. 3) of the front member 6 with a bevel chamfer cut. Referring to FIG. 22(*c*), a straight cutting tool is used to cut the top recesses 58 of the shutter blades 10 at ¼ in. deep, which is half the thickness of the board. The same tool is used to drill four indexing holes 134. Referring to FIG. 22(*d*), using a T-shaped cutting tool, the slots 40 at the top portion 16 and the bottom portion 18 of the shutter blades 10 are cut.

Referring to FIG. 22(*e*), the board 128 is then turned over and secured to the indexing pins 82 through the indexing holes 134. The surface of the board does not show any cuts, since the cuts done on the previous steps were only made partway through the thickness of the board. A straight cutting tool is used to cut the recesses 60 on the respective opposite edge of the shutter blades 10 at ¼ in. deep. The groove 34 (see FIG. 3) is also cut, typically at 1/16 in. deep for a ½ in.×½ in. washer 50. Referring to FIG. 22(*g*), using the same straight cutting tool, the ledge 32 (see FIG. 3) is cut. The cutting tool then goes through the thickness of the board, cutting around the inner edge 132, the outer edge 136 (see FIG. 3), and the outer edges of the shutter blades 10. This final cut separates the various components from the board 128.

Referring to FIGS. 23(*a*)-23(*g*), a second board is used to make the 8 shutter blades 10 and the rear member 8 of the frame 4. Referring to FIG. 23(*a*), using a V cutting tool, the inner edge 140 (see FIG. 3) is cut partway through the thickness of the board, typically at ¼ in. deep. A decorative bead groove, for example at ⅛ in. deep, is also cut with the same tool. Referring to FIG. 23(*b*), a straight cutting tool is used to cut the top recesses 58 of the shutter blades 10 to a depth half the thickness of the board, in this case, ¼ in. deep. The same tool is used to drill four indexing holes 144. Referring to FIG. 23(*c*), using a T-shaped cutting tool, the slots 40 at the top portion 16 and the bottom portion 18 of the shutter blade 10 are cut.

Referring to FIG. 23(*d*), the board 138 is then turned over and secured to the indexing pins 82 through the indexing holes 144. The surface of the board does not show any cuts, since the cuts done on the previous steps were made only partway through the thickness of the board. Referring to FIG. 23(*e*), a straight cutting tool is now used to cut the recesses 60 on the respective opposite edge of the shutter blades 10 at the same depth as the recesses 58. The upper grooves 24 and lower grooves 26 are also cut with the same tool, for example at ¼ in. and 5/16 in. deep, respectively, for ¼ in. shaft portions 42. The slots 28 for the washers 50 are also cut, for example 5/16 in. deep. The various tool paths are programmed at different depths as appropriate. Referring to FIG. 23(*f*), the same straight cutting tool cuts through the thickness of the board, cutting around the inner edge 132, the outer edge 146 (see FIG. 3), and the outer edges of the shutter blades 10. This final cut separates the various components from the board 138.

The various parts are then assembled, as shown in FIG. 3.

Referring to FIGS. 24(*a*)-24(*f*), another example of a cutting process for making a shutter embodying the present invention is disclosed. The shutter of this example has the upper grooves 24 and the lower grooves 26 disposed on both the front member 6 and the rear member 8. For a ¼ in. diameter shaft portion 42, the depth of the grooves 24 and 26 would be about ⅛ in. In this example, the shutter 2 is small enough so that a single board would be sufficient to provide all the components. The shutter of the example has 12 shutter blades.

Referring to FIGS. 24(*a*) and 24(*b*), a board 148 is placed on the table 77 of the CNC router machine 76. Decorative bead grooves 150 are cut on the front member 6 and the rear member 8 with a V-cutting tool. The inner edge 132 of the front member 6 and the inner edge 140 of the rear member 8 are cut to a depth less than the thickness of the board, which in this example is ¼ in. deep for a ½ in. thick board. The V-cutting tool used provides a chamfer edge to the edges. The recesses 60 of the shutter blades 10 are then cut with a straight cutting tool.

Referring to FIG. 24(*c*), the slots 40 at the top portion 16 and the bottom portion 18 of each shutter blade 10 are cut with a T-shaped cutting tool. The recess 58 for each shutter blade 10 is cut with straight cutting tool to a depth of ¼ in., which is half the thickness of the board in this example. Referring to FIG. 24(*d*), the upper grooves 24 and the lower grooves 26 are cut. The upper grooves 24 are cut to a depth of ¼ in. for a shaft portion 42 of ¼ in. diameter. The lower grooves 26 are cut to a depth of 5/16 in. to provide clearance for the shaft portion 42 when the washer 50 is compressed within the slot 28. Referring to FIG. 24(*e*), the slots 28 for the washers 50 are cut to a depth of 7/16 in. for a square washer about ½ in.×½ in. outside dimension. The groove 34 is also cut to a depth of 1/16 in. The groove 34 lines up with the slots 28 to provide a total depth of ½ in. to the washers 50 and allow for a compression fit. Referring to FIG. 24(*f*), the shutter blades 10 are cut through along their outer edges. The front member 6 and the rear member 8 are also cut through along their outer and inner edges. The separated components are then assembled.

Figure 25:
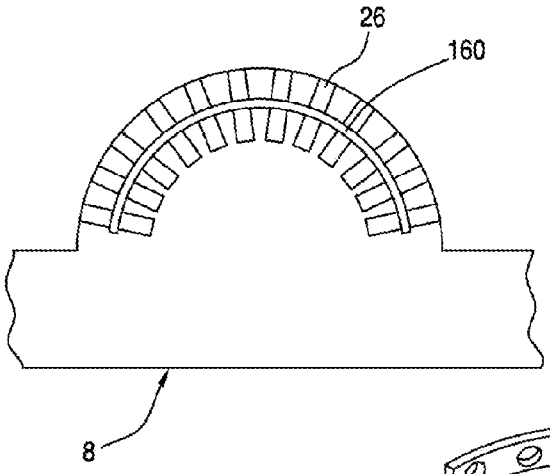
FIG. 25 is front view of a portion of the rear member shown in FIG. 3, showing an alternative slot for the friction washers.
Figure 26:
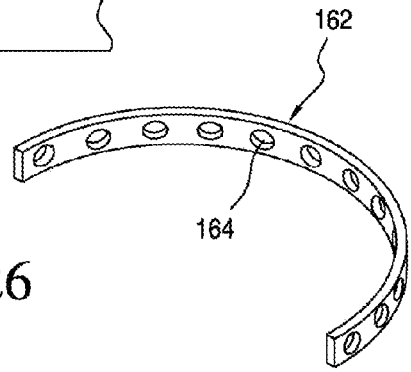
FIG. 26 is a perspective view of a friction washer.

Referring to FIG. 25, the individual slots 28 may be cut into one continuous slot 160. Referring to FIG. 26, the individual washers 50 may be made a from a longitudinal member 162 having a linear series of holes 164, each being hole spaced apart to accommodate the respective shaft portions 42 of the bottom pivots 20. The continuous slot 160 may also be used with the individual washers 40.

Figure 27:
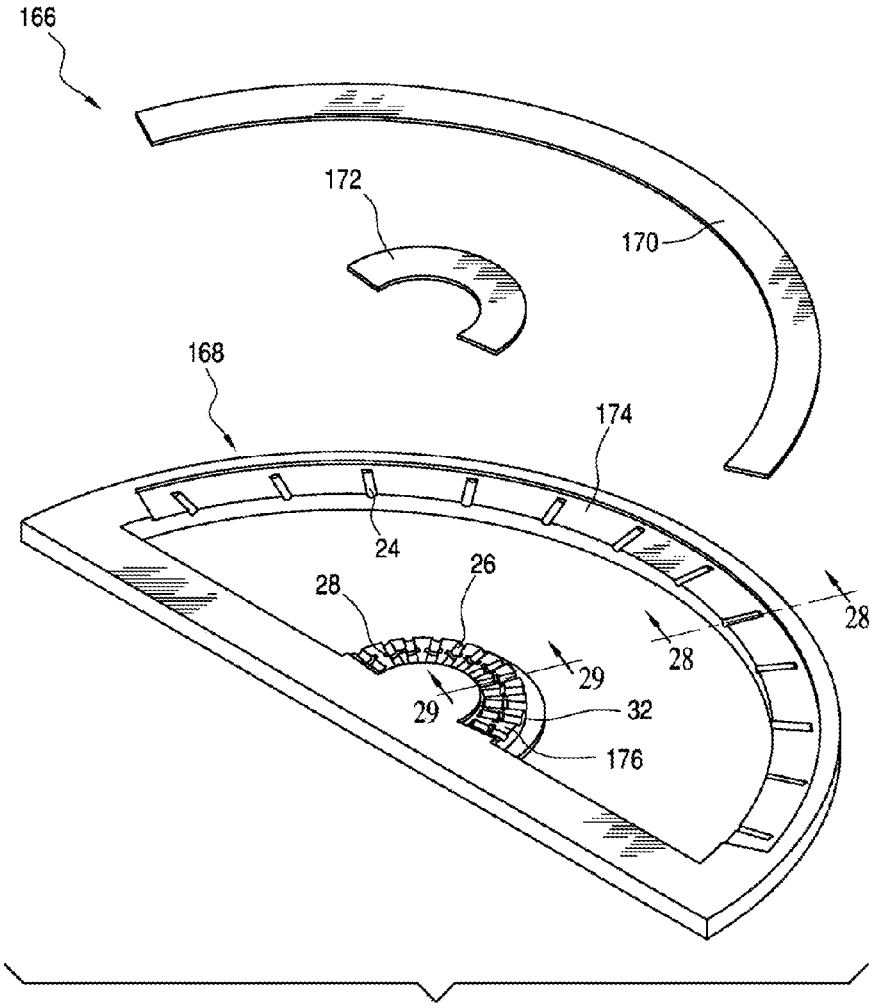
FIG. 27 is an assembly view of another embodiment of a shutter frame embodying the present invention.
Figure 29:
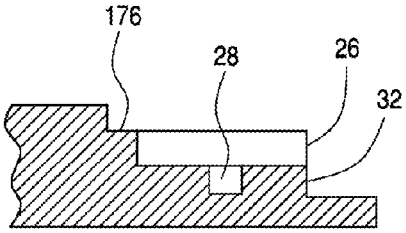
FIG. 29 is a cross-sectional view taken along line 29-29 in FIG. 27.
Figure 28:
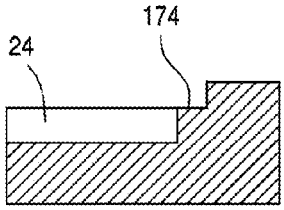
FIG. 28 is a cross-sectional view taken along line 28-28 in FIG. 27.

Referring to FIG. 27, another embodiment of a frame 166 for the shutter 2 is disclosed. The frame 166 consists of a member 168 and cover members 170 and 172. The member 168 includes the upper grooves 24, the lower grooves 26 and the slots 28. The member 168 has recesses 174 and 176 configured to receive the cover members 170 and 172, respectively, and be attached thereto by standard means, such with glue or screws, thereby bridging over the grooves. The thickness of the cover members 170 and 172 is sized to the depth of the recesses 174 and 176 for a flush fit. The cover member 170 and 172 are used to capture the shaft portions 42 disposed within the grooves 24 and 26.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

What is claimed is:

1. A method for use in manufacturing a plantation window shutter comprising a frame made of two substantially similar frame members attached together and a plurality of shutter blades pivotably supported by said frame, said method comprising the steps of: a) providing at least one shutter blade pivot, said pivot having a shaft portion and an attachment portion; b) providing a sheet material; c) cutting said sheet material with a CNC router machine to form a plurality of frame members and at least one shutter blade; d) cutting at least one groove in at least one of said frame members with said CNC router machine to receive said shaft portion; e) cutting a slot in at least one end of said at least one shutter blade with said CNC router machine to receive said attachment portion; f) assembling said pivot attachment portion to said at least one shutter blade; and g) assembling said pivot shaft portion to said frame members such that said at least one shutter blade is rotateably actuateable at least partially within said frame members, wherein said CNC router machine operates in response to data received from at least one of the internet and a network connection.

2. The method of claim 1, wherein said cutting said sheet material further comprises the steps of: a) cutting partway through the thickness of said sheet material on a first side of said sheet material; and b) cutting through the remainder of said thickness of said sheet material on a second side of said sheet material.

3. The method of claim 1, wherein said sheet material defines at least one of a plastic sheet material and a wood sheet material.

4. The method of claim 1, wherein said frame defines a plurality of frame members, and wherein at least two of said frame members are substantially similar.

5. The method of claim 1, wherein said assembling step results in assembled shutter defining a frame comprising a plurality of frame members, at least two of said frame members being substantially similar, and a plurality of shutter blades, and wherein said assembled shutter is adapted such that said shutter blades are at least partially sandwiched rotateably between said at least two frame members such that a rotation of one of said shutter blades causes synchronous rotation of other of said shutter blades.

6. A method for use in manufacturing a plantation window shutter, said method comprising the steps of: a) providing at least one shutter blade pivot, said pivot having a shaft portion and an attachment portion; b) providing a sheet material; c) using a CNC router machine forming from said sheet material a plurality of frame members and at least one shutter blade; d) forming at least one groove in at least one of said frame members to receive said shaft portion; e) forming a slot in at least one end of said at least one shutter blade to receive said attachment portion; f) assembling said pivot attachment portion to said at least one shutter blade; and g) assembling said pivot shaft portion to said frame members such that said at least one shutter blade is rotateably actuateable at least partially within said frame members, wherein said CNC router machine operates in response to data received from at least one of the internet and a network connection.

7. The method of claim 6, wherein said forming from said sheet material further comprises the steps of: a) cutting partway through the thickness of said sheet material on a first side of said sheet material; and b) cutting through the remainder of said thickness of said sheet material on a second side of said sheet material.

8. The method of claim 6, wherein said sheet material defines at least one of a plastic sheet material and a wood sheet material.

9. The method of claim 6, wherein said frame defines a plurality of frame members, and wherein at least two of said frame members are substantially similar.

10. The method of claim 6, wherein said assembling step results in assembled shutter defining a frame comprising a plurality of frame members, at least two of said frame members being substantially similar, and a plurality of shutter blades, and wherein said assembled shutter is adapted such that said shutter blades are at least partially sandwiched rotateably between said at least two frame members such that a rotation of one of said shutter blades causes synchronous rotation of other of said shutter blades.

11. The method of claim 10, wherein said shutter includes a rotatable knob adapted such that rotation of said rotatable knob causes a corresponding rotation of said shutter blades.

12. A method for use in manufacturing a shutter, said method comprising the steps of: a) providing at least one shutter blade having at least one pivot; b) providing a material; c) using a CNC router machine forming from said material a frame having at least one groove to receive said pivot; and d) assembling said pivot to said at least one frame groove to form a shutter wherein said at least one shutter blade is rotateably supported by said frame, wherein said CNC router machine operates in response to data received from at least one of the internet and a network connection.

13. The method of claim 12, wherein said forming from said material further comprises the steps of: a) cutting partway through the thickness of a sheet material on a first side of said sheet material; and b) cutting through the remainder of said thickness of said sheet material on a second side of said sheet material.

14. The method of claim 12, wherein said material defines a sheet material.

15. The method of claim 12, wherein said material defines at least one of a plastic sheet material and a wood sheet material.

16. The method of claim 12, wherein said at least one shutter blade is formed from said provided material using a CNC router machine.

17. The method of claim 12, wherein said frame defines a plurality of frame members.

18. The method of claim 12, wherein said frame defines a plurality of frame members, and wherein at least two of said frame members are substantially similar.

19. The method of claim 12, wherein said shutter includes a rotatable knob adapted such that rotation of said rotatable knob causes a corresponding rotation of said shutter blades.

20. The method of claim 12, wherein said assembled shutter defines a frame comprising a plurality of frame members, at least two of said frame members being substantially similar, and a plurality of shutter blades, and wherein said assembled shutter is adapted such that said shutter blades are at least partially sandwiched rotateably between said at least two frame members such that a rotation of one of said shutter blades causes synchronous rotation of other of said shutter blades.

* * * * *